US006494384B1

(12) United States Patent
Meyer

(10) Patent No.: US 6,494,384 B1
(45) Date of Patent: Dec. 17, 2002

(54) REVERSIBLE AND ADJUSTABLE PART CIRCLE SPRINKLER

(75) Inventor: Larry P. Meyer, Walla Walla, WA (US)

(73) Assignee: Nelson Irrigation Corporation, Walla Walla, WA (US)

( * ) Notice: Subject to any disclaimer, the term of this patent is extended or adjusted under 35 U.S.C. 154(b) by 11 days.

(21) Appl. No.: 09/827,176

(22) Filed: Apr. 6, 2001

(51) Int. Cl.[7] ..... B05B 3/02

(52) U.S. Cl. ..... 239/222.11; 239/222.17; 239/233; 239/237; 239/230; 239/252; 239/498

(58) Field of Search ..... 239/222.11, 222.15, 239/222.17, 222.19, 223, 224, 230, 232, 233, 237, 242, 249, 252, 498, 500, 501, 502

(56) References Cited

U.S. PATENT DOCUMENTS

| | | | | |
|---|---|---|---|---|
| 3,022,012 A | | 2/1962 | Sharp et al. | |
| 4,434,937 A | * | 3/1984 | Pitchford | 239/230 |
| 4,611,760 A | | 9/1986 | Koresh | |
| 4,763,839 A | | 8/1988 | Greenberg | |
| 4,805,838 A | | 2/1989 | Greenberg | |
| 4,817,869 A | * | 4/1989 | Rubinstein | 239/222.17 |
| 4,957,240 A | | 9/1990 | Rosenberg | |
| 5,058,806 A | | 10/1991 | Rupar | |
| 5,232,157 A | * | 8/1993 | Laffrey | 239/222.17 |
| 5,288,022 A | | 2/1994 | Sesser | |
| 5,671,886 A | * | 9/1997 | Sesser | 239/233 |
| 5,984,205 A | * | 11/1999 | Rosenberg | 239/233 |
| 6,076,746 A | | 6/2000 | Kantor et al. | |

* cited by examiner

*Primary Examiner*—Lesley D. Morris
*Assistant Examiner*—Dinh Q. Nguyen
(74) *Attorney, Agent, or Firm*—Nixon & Vanderhye P.C.

(57) ABSTRACT

A sprinkler head includes a fixed nozzle; and a rotor plate spaced from the nozzle and mounted for rotation about an axis extending through the nozzle, and mounted for tilting movement about a horizontal axis. The rotor plate has adjacent water distribution grooves therein, selectively alignable with the nozzle, the grooves shaped and arranged to cause the rotor plate to rotate in opposite directions. A flow reaction member is secured to the rotor plate. A first flow channel having a first inlet port is arranged to intercept a stream emanating from one of the grooves aligned with the nozzle, and to thereby divert at least a portion of the stream through the flow channel and onto the reaction member to cause the rotor plate to tilt about the horizontal axis and align the other of the grooves with the nozzle, thereby reversing the rotation direction of the rotor plate. A second flow channel has a second inlet port circumferentially offset from the first inlet port is arranged to intercept a stream emanating from the other of the grooves aligned with the nozzle and to thereby divert at least a portion of the stream through the second flow channel and onto another portion of the reaction member to cause the rotor plate to tilt about the horizontal axis and align one of the grooves with the nozzle, thereby again reversing the rotation direction of the rotor plate. The first and second inlet ports are adjustable to change the arcuate coverage of the sprinkling pattern.

17 Claims, 3 Drawing Sheets

REVERSIBLE AND ADJUSTABLE PART CIRCLE SPRINKLER

TECHNICAL FIELD

This invention relates to sprinklers generally, and more particularly, to a flow actuated reversible and adjustable part circle sprinkler.

BACKGROUND AND SUMMARY OF THE INVENTION

Typical reversible and adjustable arc sprinklers employ various mechanisms to reverse the direction of rotation of the sprinkler head including, for example, mechanical trippers and magnets. See U.S. Pat. Nos. 4,805,838, 4,763,839 and 4,540,125. There remains a need, however, for a reversible, adjustable arc sprinkler of simple and reliable construction.

The present invention provides a reversible, adjustable arc sprinkler head that utilizes partial flow from the emitted stream to reverse the direction of rotation of the sprinkler. More specifically, in the exemplary embodiment of the invention, a water distribution plate (rotor plate) is mounted above a fixed nozzle. The rotor plate is mounted on a shaft for rotation about the shaft axis, and the rotor plate is also fixed to the shaft by means of a horizontal pin, allowing the rotor plate to tilt about a horizontal axis. The rotor plate is formed with a pair of water distribution grooves, either one of which is alignable with the fixed nozzle. The grooves are configured so that when a stream emitted from the nozzle impinges on one groove, the rotor plate will rotate in one direction, and when it impinges on the other of the pair of grooves, the rotor plate will rotate in an opposite direction.

A partially annular reaction wing or member is fixed to the rotor plate for rotation therewith, the wing including an extended radial tab, the purpose for which will be described in greater detail further below.

The sprinkler includes a first plate in which the nozzle is secured and a second plate axially spaced from the first plate. The second plate is formed with a center opening that supports a third plate for rotation relative to the second plate. The shaft on which the rotor plate is mounted as well as a viscous damping device or "motor" that slows the rotation of the rotor plate, is supported centrally within the third plate. In accordance with an exemplary embodiment of the invention, first and second flow tubes, of generally inverted U-shape, are secured to the second and third sprinkler plates, respectively. More specifically, a first flow tube is supported on the third plate, with a pick-up port located below the lower surface of the plate, and an exit port substantially flush with the lower surface of the third plate, both ports lying on an imaginary circle inscribed on the third plate. A second flow tube is supported on the second plate, with a pick-up port located below the lower surface of the second plate and an exit port substantially flush with the lower surface of the second plate, both ports lying on an imaginary circle inscribed on the second plate, with the second imaginary circle having a diameter greater than the diameter of the first imaginary circle. The first and second pick-up ports have openings arranged to intercept the stream thrown radially by the rotor plate.

In use, as the rotor plate rotates, the substantially radially directed stream is intercepted by one of the pick-up ports, such that momentarily, at least some portion of the stream is directed through the respective flow tube and out the exit port, impinging on the reaction wing and tipping it to align the other rotor plate groove with the nozzle stream, thus reversing the direction of rotation of the rotor plate. This reversing process is repeated each time one of the pick-up ports intercepts the stream with the attendant tipping of the rotor plate.

The third plate is rotatable relative to the second plate, thus allowing the respective pick-up ports to be adjusted relative to each other, thereby adjusting the arc of coverage of the stream. Lock tabs are provided to lock the third plate relative to the second plat to fix the arc until altered by the user.

Thus, in one aspect, the present invention provides a sprinkler head comprising a first plate supporting a stationary nozzle having a discharge orifice; a second plate supported in axially spaced relationship to the first plate; a third plate carried by the second plate for rotation relative thereto, the third plate supporting a rotor plate provided with a pair of water distribution grooves for rotation about a first vertical axis and for back and forth tilting movement about a horizontal axis; a reaction member extending laterally from the rotor plate; a first flow tube mounted on the third plate with a first pick-up port and a first exit port in the third plate, the first pick-up port alignable with one of the water distribution grooves and the first exit port alignable with a selected area on the reaction member; a second flow tube mounted on the second plate with a second pick-up port and a second exit port in the second plate, the second pick-up port alignable with the other of the water distribution grooves and the second exit port alignable with another selected area on the reaction member.

In another aspect, the invention provides a sprinkler head comprising a fixed nozzle; a rotor plate spaced from the nozzle and mounted for rotation about an axis extending through the nozzle, and mounted for tilting movement about a horizontal axis, the rotor plate having adjacent water distribution grooves therein selectively alignable with the nozzle, the grooves shaped and arranged to cause the rotor plate to rotate in opposite directions, and a flow reaction member secured thereto; a first flow channel having a first inlet port arranged to intercept a stream emanating from one of the grooves aligned with the nozzle, and to thereby divert at least a portion of the stream through the flow channel and onto a first portion of the reaction member to cause the rotor plate to tilt about the horizontal axis and align the other of the grooves with the nozzle, thereby reversing the rotation direction of the rotor plate.

Other objects and advantages will become apparent from the detailed description that follows.

DETAILED DESCRIPTION OF THE DRAWINGS

Figure 1:
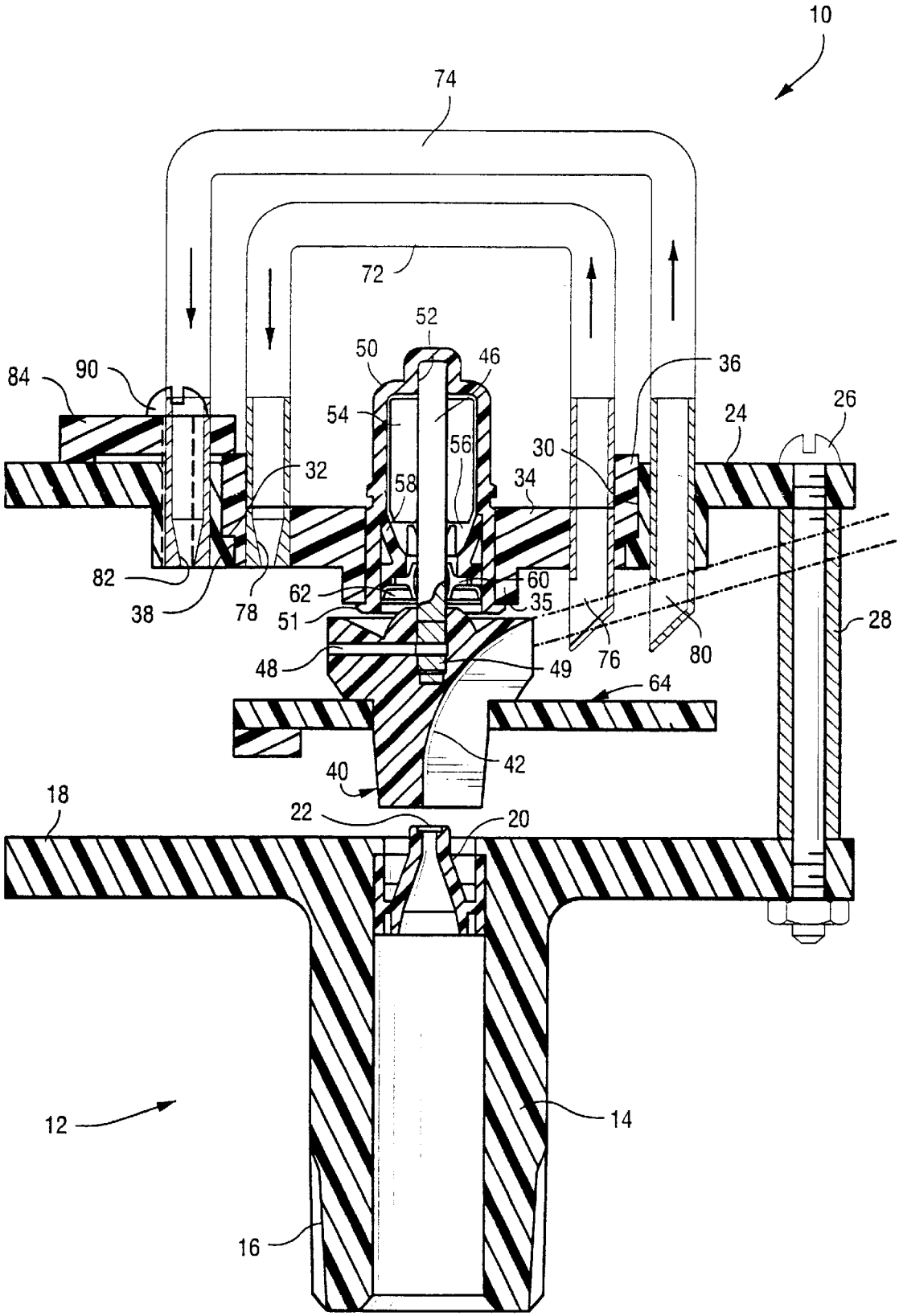
FIG. 1 is a cross section of a sprinkler head in accordance with the invention, with flow tubes projected on a single vertical plane for clarity.
Figure 2:
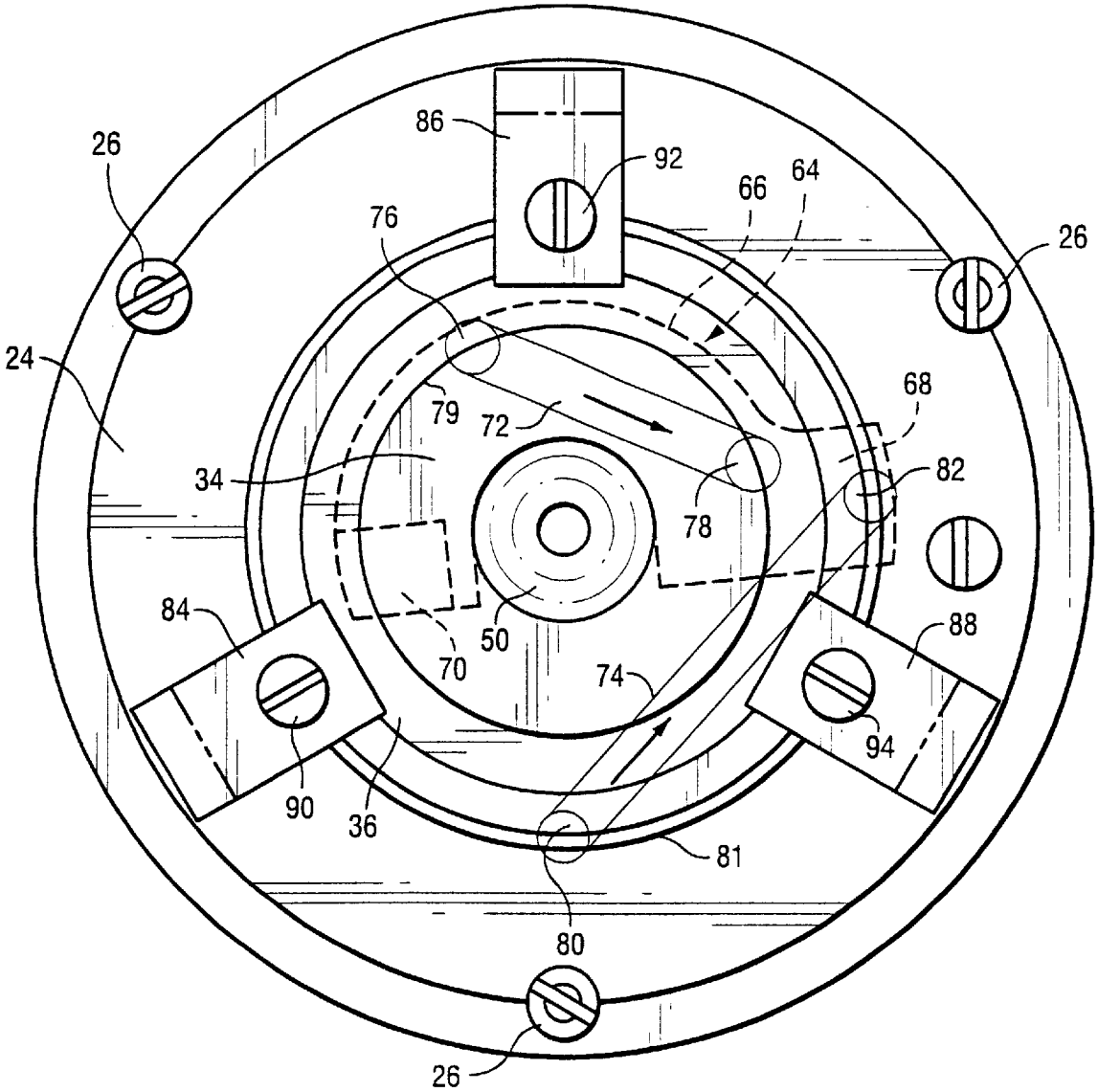
FIG. 2 is a plan view of a sprinkler head in accordance with the invention.

Referring initially to FIGS. 1 and 2, the sprinkler head 10 includes a lower body portion 12 having a cylindrical inlet 14 including a threaded end 16 adapted for connection to a riser, sprinkler base, or the like. The upper body portion includes a first disk-like plate 18 supporting an otherwise conventional fixed nozzle 20. Nozzle 20 emits an axial stream to atmosphere via orifice 22. Supported above the plate 18 is a second disk-like plate 24, secured in fixed relation to the plate 18 by a plurality (three in the illustrated embodiment) of screws 26 and associated spacer sleeves 28.

The second plate is formed with a center opening defined by an inner peripheral edge 30 and a radially inwardly directed shoulder 32. A third plate 34 having an upstanding peripheral wall 36 and annular step 38 is rotatably supported on the second plate 24. Specifically, radial shoulder 32 supports the third plate 34 via the step 38, with a light friction fit between the inner peripheral edge 30 of plate 24 and the exterior surface of wall 36 of the plate 34, so that plate 34 may rotate relative to plate 24.

Figure 3:
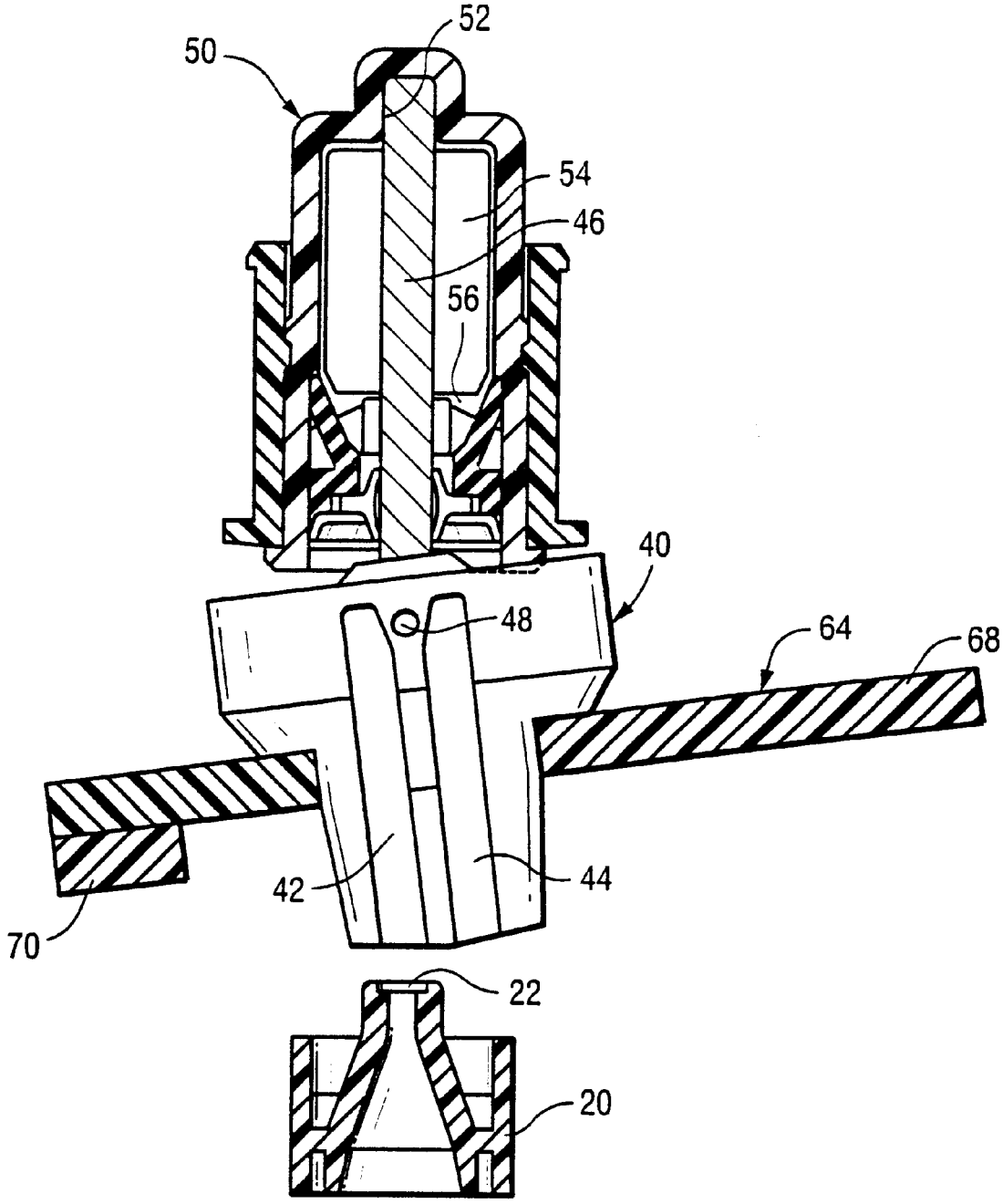
FIG. 3 is a partial section through the sprinkler head of the invention showing the rotor plate tilted from vertical to align with a groove in the rotor plate with the nozzle orifice.

The third plate 34 supports a rotor plate 40 formed with a pair of stream distribution grooves 42, 44, best seen in FIG. 3, the axial end of each of which is alignable with the nozzle orifice 22. The grooves 42, 44 extend axially and then substantially radially such that a stream received from the nozzle 20 in either groove will be thrown radially away from the sprinkler.

The rotor plate 40 is mounted on a shaft 46 for rotation with the shaft about the longitudinal axis of the shaft. The rotor plate 40 is fixed to the shaft 46 by means of a transverse pin 48 and bearing 49 that permit the rotor plate to tilt back and forth about the pin 48. Since grooves 42, 44 lie on either side of the pivot pin 48, when one or the other of grooves 42, 44 is aligned with the nozzle orifice 22, the rotor plate is tilted about the pivot pin. The tilting of the rotor plate and the configuration of the grooves cause the rotor plate 40 and shaft 46 to rotate about the axis of the shaft. The direction of rotation depends on which groove is aligned with the nozzle. As viewed in FIG. 3, when the stream impinges on groove 42, the rotor plate will rotate in a clockwise direction about the axis of shaft 46.

Rotation of the rotor plate 40 with the shaft 46 is slowed by a viscous dampening "motor" (or viscous retarder) of the type generally shown in commonly owned U.S. Pat. Nos. Re. 33,823; 5,058,806; and 5,288,022. Generally, a motor housing 50 is supported within a center opening in the plate 34, with lower flange 51 of the housing engaged with a circular boss 35 on the plate 34. The shaft 46 terminates in a recess 52 formed in the upper end of the housing, and supports a rotor 54 within a chamber 56 in the housing closed by seals 58, 60 and retainer 62. The chamber 56 is at least partially filled with a viscous fluid such that rotation of the rotor plate 40 is slowed significantly, thereby maximizing the radius of throw of the stream.

As already indicated, the pivotable mounting of the rotor to the shaft 30 via pin 48, allows tipping of he rotor to align one or the other of the grooves 42, 44 with the nozzle 20 to selectively effect forward and reverse operation. As will be appreciated, the rotor is held in either the forward or reverse position by the action of the nozzle stream against the surfaces of the respective grooves 42, 44.

A part annular reaction member, or "wing" 64 is secured (by press fit, for example) to the rotor plate 40 for rotation therewith. The reaction member 64 extends laterally of shaft 46 and approximately 210° about the rotor (see FIG. 2). The wing 64 includes a radiused edge 66 and a lateral tab 68 that extends radially beyond the radiused edge. Diametrically opposed to the tab 68 is a balance weight 70 that underlies a section of the wing 64 and that offsets the weight of the extended tab 68. The weight 70 may be made integral with the reaction member 64 if desired.

Also mounted on the sprinkler are a pair of flow pick-up tubes or channels 72, 74, each of which has a generally inverted U-shape, such that each tube has an inlet or pick-up port and an outlet or exit port in its respective supporting plate. Specifically, a first tube 72 is arranged on the third plate 34 and includes a pick-up port 76 extending downwardly beneath the plate 34, at a location radially spaced from the axis of the shaft 46. Tube 72 also includes an exit port 78 the same distance from the axis but displaced by about 98° relative to pick-up port 76, with the exit port arranged substantially flush with the underside of the plate 34. In other words, and with reference to FIG. 2, the pick-up port 76 and exit port 78 have centers on an imaginary circle 79 and the horizontal portion of the tube corresponds generally to a chord drawn between the two centers.

The second tube 74 is arranged on the second plate 24 and includes a pick-up port 80, also extending downwardly beneath the plate 34 at a location radially outwardly of pick-up port 76, and an exit port 82 the same distance from the axis as pick-up port 80, but displaced by about 98° relative to pick-up port 80. Ports 80 and 82 thus have centers that lie on an imaginary circle 81 of larger diameter than imaginary circle 79. The pick-up and exit ports are shown in FIG. 1 as being in a single vertical plane for clarity only. The angular relationship is more accurately shown in FIG. 2. In addition, the wing 64 is rotated 90° out of position, vis-a-vis the rotor plate 40 and particularly pivot pin 48, in FIG. 1 for illustration purposes only. The correct orientation is shown in FIG. 3. Pick-up ports 76 and 80 face inwardly to intercept the stream as it is thrown radially outwardly from the rotor plate 40. Pick-up tubes 72, 74 could, in an alternative configuration, be formed as inverted U-section (i.e., open) channels, bent through a radius from pick-up port to exit port.

In operation, the rotor plate 40 turns by reaction of the nozzle stream in one or the other of grooves 42, 44. As shown in FIG. 3, the stream emitted from discharge orifice 22 of nozzle 20 will impinge on groove 42 and cause the rotor plate to rotate in a first clockwise direction, with the rotor plate held in this position by the stream engaging a side wall of the groove. With specific reference to FIGS. 2, when the rotor plate 40 rotates to a location where the stream from groove 42 is momentarily intercepted by pick-up port 80, some of the stream will enter that port, flow through the tube 74 and flow out of the exit port 82 onto the extended tab 68, tilting the reaction member 64 and rotor plate 40 about the pin 48, so as to move the other groove 44 into alignment with the nozzle orifice 22. Now the rotor plate rotates in the opposite direction until the stream is momentarily intercepted by the pick-up port 76. Water then flows through tube 72, out of the exit port 78 and impinges on the reaction member 64 at a location substantially diametrically opposed to the tab 68 (i.e., in the area above the balance weight 70), thereby again tilting the rotor plate 40 and reaction member 64 about the pin 48 to move groove 42 back into alignment with the stream. This reversal process is repeated as the rotor plate rotates between the respective pick-up ports.

Because the third plate 34 is rotatable relative to the second plate 24, the arcuate length between pick-up ports 76 and 80 can be varied, thus adjusting the arcuate travel of the rotor plate. Once adjusted to the desired arc, tab locks 84, 86, 88 may be tightened via screws 90, 92, 94, respectively, to fix the plate 34 relative to plate 24. If the sprinkler is started out of the arc set, i.e., outside of the arc of coverage, rotor plate 40 will rotate one way or the other (less than one full turn) until it falls into the proper setting, initiated by one or the other of the pick-up ports.

As nozzle size or rate of flow increases, the power required to shift also increases. Because the water stream itself does the shifting, however, these two forces run in parallel, and the reversing mechanism is fully functional at various flow rates above a minimum rate required to tilt and rotate the rotor plate.

Because there is no linkage or springs to overcome, the rotor continues to turn without slowing until the shift point is reached. This is an advantage with the low torque output of the rotator drive. The water stream itself is the most powerful force available when using this type of drive.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A sprinkler head comprising:

a first plate supporting a stationary nozzle having a discharge orifice;

a second plate supported in axially spaced relationship to said first plate;

a third plate carried by said second plate for rotation relative thereto, said third plate supporting a rotor plate provided with a pair of water distribution grooves for rotation about a first vertical axis-and for back and forth tilting movement about a horizontal axis;

a reaction member extending laterally from said rotor plate;

a first flow channel mounted on said third plate with a first pick-up port and a first exit port in said third plate, said first pick-up port alignable with one of said water distribution grooves and said first exit port alignable with a selected area on said reaction member;

a second flow channel mounted on said second plate with a second pick-up port and a second exit port in said second plate, said second pick-up port alignable with the other of said water distribution grooves and said second exit port alignable with another selected area on said reaction member.

2. The sprinkler head of claim 1 wherein said rotor plate is supported in a shaft defining said first vertical axis, said shaft extending into a housing supported on said third plate, said housing having an interior chamber; a rotor fixed to said shaft and located in said chamber; and wherein said chamber is at least partially filled with a viscous fluid.

3. The sprinkler head of claim 1 wherein at least one locking tab is mounted on one of said second and third plates for releasably locking said second and third plates together.

4. The sprinkler head of claim 1 wherein said first pick-up port and said first exit port are located on a first imaginary circle; and said second pick-up port and said second exit port are located on a second imaginary circle larger than said first circle.

5. The sprinkler head of claim 4 wherein said reaction member comprises a radiused portion vertically alignable with said first exit port and wherein said another selected area comprises a radially extended tab vertically alignable with said second exit port.

6. The sprinkler head of claim 5 wherein said first and second pickup ports are arranged to intercept a stream thrown radially from said water distribution grooves such that, in use, impingement of a stream from said first exit port on said radiused portion of said reaction member causes said rotor plate to tilt about said horizontal axis in one direction and align one of said water distribution grooves with said nozzle; and further wherein impingement of a stream from said second exit port on said radially extending tab of said reaction member causes said rotor plate to tilt about said horizontal axis in an opposite direction and align the other of said water distribution grooves with said nozzle.

7. The sprinkler head of claim 5 wherein said rotor plate is supported in a shaft defining said first vertical axis, said shaft extending into a housing supported on said third plate, said housing having an interior chamber; a rotor fixed to said shaft and located in said chamber; and wherein said chamber is at least partially filled with a viscous fluid.

8. The sprinkler head of claim 1 wherein said reaction member comprises a radiused portion and said another selected area including a radial tab extending beyond said radiused portion.

9. The sprinkler head of claim 8 wherein said first and second pick-up ports are arranged to intercept a stream thrown radially from said water distribution grooves such that, in use, impingement of a stream from said first exit port on said radiused portion of said reaction member causes said rotor plate to tilt about said horizontal axis in one direction and align one of said water distribution grooves with said nozzle; and further wherein impingement of a stream from said second exit port on said radially extending tab of said reaction member causes said rotor plate to tilt about said horizontal axis in an opposite direction and align the other of said water distribution grooves with said nozzle.

10. A sprinkler head comprising:

a fixed nozzle;

a rotor plate spaced from said nozzle and mounted for rotation about an axis extending through said nozzle, and mounted for tilting movement about a horizontal axis, said rotor plate having adjacent water distribution grooves therein selectively alignable with said nozzle, said grooves shaped and arranged to cause said rotor plate to rotate in opposite directions, and a flow reaction member secured thereto;

a first flow channel having a first inlet port arranged to intercept a stream emanating from one of said grooves aligned with said nozzle, and to thereby divert at least a portion of said stream through said flow channel and onto a first portion of said reaction member to cause said rotor plate to tilt about said horizontal axis and align the other of said grooves with said nozzle, thereby reversing the rotation direction of the rotor plate.

11. The sprinkler head of claim 10 including a second flow channel having a second inlet port circumferentially offset from said first inlet port and arranged to intercept a stream emanating from the other of said grooves aligned with the nozzle and to thereby divert at least a portion of said stream through said second flow channel and onto another portion of said reaction member to cause said rotor plate to tilt about said horizontal axis and align said one of said grooves with said nozzle, thereby reversing the rotation direction of the rotor plate.

12. The sprinkler head of claim 11 wherein said first and second inlet ports are arcuately adjustable relative to each other.

13. The sprinkler head of claim 11 wherein said nozzle is supported in a first plate, and wherein second and third concentrically arranged plates are supported in axially spaced relationship with said first plate, said rotor plate and one of said first and second flow channels supported by said third plate, and the other of said first and second flow channels supported by said second plate.

14. The sprinkler head of claim 13 wherein said rotor plate is mounted on a shaft defining said first vertical axis, said shaft extending into a housing supported on said third plate, said housing having an interior chamber; a rotor fixed to said shaft and located in said chamber; and wherein said chamber is at least partially filled with a viscous fluid.

15. The sprinkler head of claim 13 wherein said second plate is rotatable relative to said third plate such that said inlet ports are arcuately adjustable relative to each other.

16. The sprinkler head of claim 15 wherein at least one locking tab is mounted on one of said second and third plates for releasably locking said second and third plates together.

17. The sprinkler head of claim 10 wherein said one portion of said reaction member comprises a radiused portion vertically alignable with said first exit port and wherein said another portion of said reaction member comprises a radially extended tab vertically alignable with said second exit port.

* * * * *